United States Patent [19]

Leidinger et al.

[11] Patent Number: 4,852,660

[45] Date of Patent: Aug. 1, 1989

[54] GRADER BLADE HAVING A PRESSURIZED FLOAT POSITION

[75] Inventors: Gustav Leidinger, Friedberg; Günther Pröll; Walter Kolb, both of Augsburg, all of Fed. Rep. of Germany

[73] Assignee: O & K Orenstein & Koppel Aktiengesellschaft, Dortmund, Fed. Rep. of Germany

[21] Appl. No.: 265,300

[22] Filed: Oct. 28, 1988

[30] Foreign Application Priority Data

Nov. 21, 1987 [DE] Fed. Rep. of Germany ..... 3739525

[51] Int. Cl.[4] ..... E02F 3/85; E01H 6/00

[52] U.S. Cl. ..... 172/795; 91/531; 60/494

[58] Field of Search ..... 172/795, 781, 7, 2, 172/4.5, 791, 792, 793, 794, 796, 797; 91/437, 511, 518, 519, 521, 522, 526, 530, 531; 60/494

[56] References Cited

U.S. PATENT DOCUMENTS

| | | | |
|---|---|---|---|
| 2,949,097 | 8/1960 | Kaay | 91/437 X |
| 3,709,103 | 1/1973 | Dukhovny et al. | 91/437 |
| 3,872,670 | 3/1975 | Dezelan et al. | 60/413 |
| 3,908,515 | 9/1975 | Johnson | 91/437 X |
| 4,024,796 | 5/1977 | Theobald | 91/437 X |
| 4,034,815 | 7/1977 | Dezelan | 172/795 |
| 4,341,149 | 7/1982 | Dezelan | 91/526 |
| 4,372,193 | 2/1983 | Hall | 91/518 X |
| 4,651,624 | 3/1987 | Beck | 91/459 X |

*Primary Examiner*—Richard J. Johnson
*Assistant Examiner*—Jeffrey L. Thompson
*Attorney, Agent, or Firm*—Browdy and Neimark

[57] ABSTRACT

A grader has a grader blade which can be pressed against the ground or lifted off it by means of piston-cylinder drives. To be able to vary the downard pressure of the grader blade in its float position, either the piston chamber or the piston ring chamber of each drive can be charged with a working fluid under pressure when the grader blade is in the float position, so that the corresponding drive exerts a force on the grader blade which increases or decreases the downward pressure of the grader blade on the ground. While still allowing the grader blue to follow the contour of the ground.

11 Claims, 5 Drawing Sheets

GRADER BLADE HAVING A PRESSURIZED FLOAT POSITION

BACKGROUND OF THE INVENTION

1. Field of the Invention

The invention relates to graders having a grader blade arranged generally transverse to the center longitudinal plane of a vehicle.

2. The Prior Art

It is known in connection with such grading vehicles, which are also known as graders, or in connection with wheel loaders, to bring the grader blade or the bucket into a so-called float position, in which the two chambers located on each side of the piston inside the piston-cylinder drive are hydraulically short-circuited so that the grader blade or the bucket rests on the ground only because of its dead weight. In connection with graders this float position is used for snow removal, while it is used for leveling the ground in connection with wheel loaders. One of the problems is that the dead weight of the grader blade or the bucket does not always result in the desired down pressure.

SUMMARY OF THE INVENTION

It is therefore an object of the invention to improve a grader of the type according to the species in such a way that the down pressure of the grader blade can be varied in the float position.

This object is attained in accordance with the invention by providing that either the piston chamber or the piston ring chamber of each lifting drive is chargeable with working fluid under pressure in the float position of the grader blade, so that it exerts a force on the grader blade which increases or decreases the down pressure of the grader blade on the ground. The point of departure and core of the invention lies in the fact that in the float position the pressure on the grader blade can be increased or decreased either over its entire length or only towards one side. It is thus possible, for example, to put pressure in excess of its dead weight only on one side in order to scrape off ice at the edge of the road. In order to scrape ice across the entire width or to perform planing operations on very hard ground, it may be desirable to increase the down pressure beyond the dead weight of the grader blade across its entire width. On the other hand it may be desirable to protect the road surface by not permitting the entire dead weight of the grader blade to act on the ground, either on one side or across its entire width.

When speaking of grading vehicles, these may also be wheel loaders or bulldozers, the buckets of which are used in this case for leveling the ground, therefore in a planing operation, i.e. having the function of a grader blade.

Advantageous characteristics of the additional, continuously variable forces are provided by a number of features of the invention as follows. The total force exerted by all lifting drives which reduces the downward pressure of the grader blade on the ground maximally corresponds to the force resulting from the dead weight. The force increasing the downward pressure of the grader blade on the ground corresponds to a multiple of the force which reduces the downward pressure. The force increasing the downward pressure of the grader blade on the ground is approximately three to five times greater than the force decreasing the downward pressure.

According to a feature of the present invention, an advantageous possibility is provided by a hydraulic control by means of which the additional increasing or decreasing forces can be generated while maintaining the float position. The piston chamber and the piston ring chamber of each drive are provided with check valves open in the float position, upstream of which a selector valve is disposed by means of which working fluid under pressure can be supplied either to the piston chamber or the piston ring chamber. A pressure relief valve controlling the pressure of the working fluid and adjustable to varied pressures of the working fluid is assigned to the selector valve. In a float position the downward pressure of a grader blade on the ground is constant, i.e. it can yield to obstacles. This means in other words that a grader blade is not hydraulically locked in a float position.

According to a further feature of the invention the various maximal changes of the initial tension can be generated to obtain an increase in the downward pressure or a decrease in the downward pressure. The pressure relief valve has a valve piston charged by means of an initially tensioned compression spring, the initial tension of which is variable by means of an operating lever which, for setting a pressure of the working fluid for reducing the downward pressure of the grader blade, effects a lesser increase of the initial tension of the compression spring then for setting the pressure of the working fluid for increasing the downward pressure of the grader blade. A particularly simple possibility for generating various changes in the initial tension by means of a control lever, which creates a step-down, results from providing that the operating lever either directly acts on the compression spring or via a control lever effecting the stepdown. Advantageous structural details in connection with this result from a control bolt which abuts on the compression spring, on one side of which acts on the operating lever directly or via the control lever.

According to an embodiment in accordance with the present invention it is assured that working fluid, its working pressure defined, enters the correct chamber of the piston-cylinder drive. An electrical switch is connected with the operating lever by means of which, when the operating lever is moved, the selector valve is switched to the chamber of the drive assigned to the switching direction of the operating lever.

Basically the pressure limiting valve selected for influencing the pressure of the working fluid may be associated directly with the main pressure line of the working fluid; however, as a rule it is practical to provide a pressure relief valve for the main pressure line which is controllable by means of a control fluid, and to use the controllable pressure relief valve as pilot valve for the control fluid.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

Further details of the invention ensue from the following description of an exemplary embodiment by means of the drawings, in which.

DETAILED DESCRIPTION OF THE PREFERRED EMBODIMENT

Figure 1:
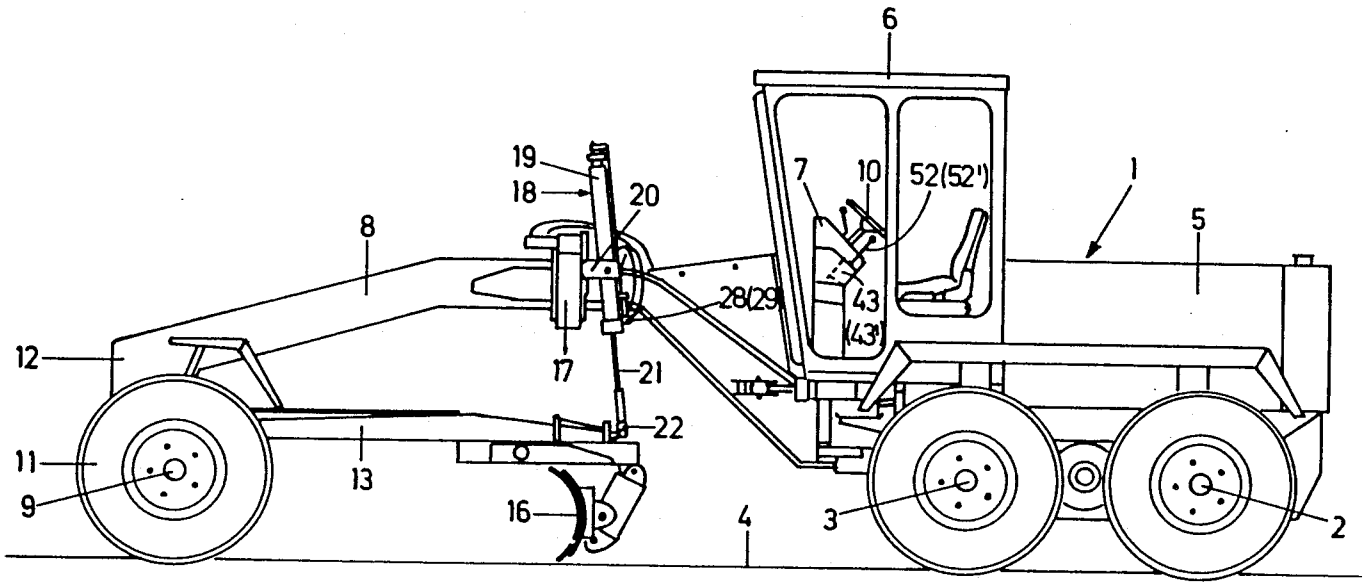
FIG. 1 is a lateral longitudinal view of a grader.
Figure 2:
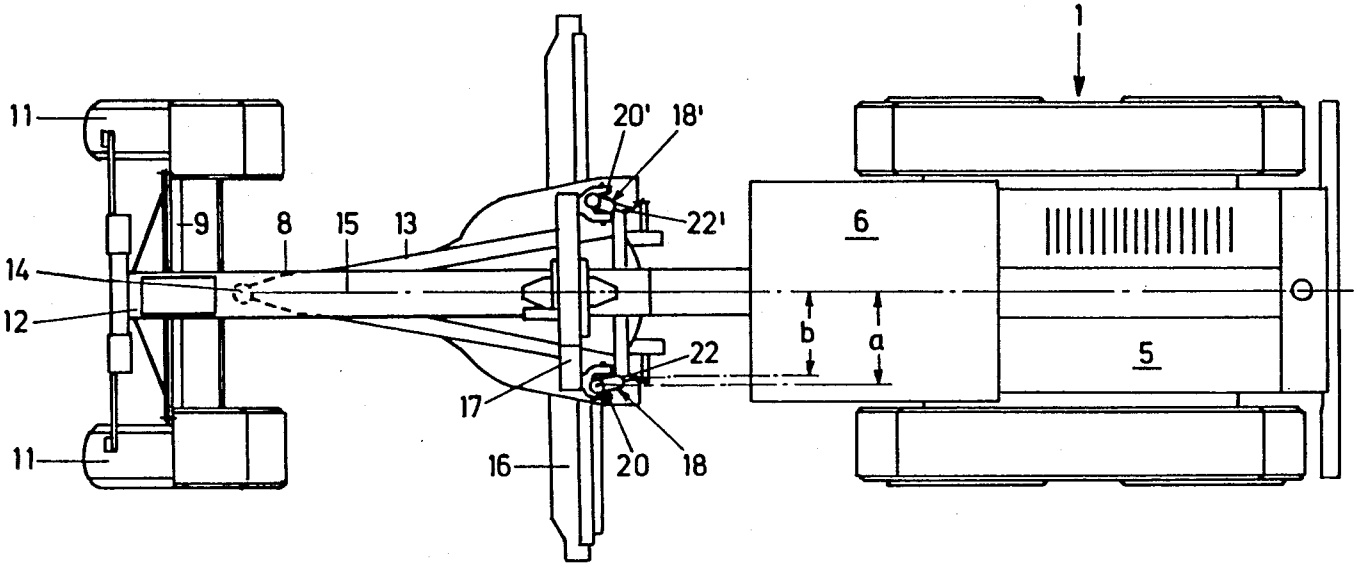
FIG. 2 is a top view of a grader according to FIG. 1.

The grading vehicle, also called a grader, shown in FIGS. 1 and 2, comprises a vehicle 1 supported on the ground 4 by two drive axles 2, 3. A motor is disposed in an engine compartment 5 for propelling the grader, i.e. at least one of the drive axles 2 or 3 and for driving all required auxiliary and main units.

In addition, the vehicle 1 has an operating console 7 in a cab 6.

A bridge-shaped implement frame 8 is disposed on the vehicle 1 ahead of the cab 6, which is provided with a front axle 9 on its front end facing away from the cab 6, to which are attached steerable front wheels 11 which are steered by means of a steering wheel 10 attached to the operating console 7. In the area of this front end 12 of the implement frame 8 a support girder 13, extending underneath the implement frame 8 in the direction of the cab 6, is linked by means of a universal joint 14. This support girder 13 is widened in the form of a fork on its end towards the cab 6 and supports, in the widened portion, a grader blade 16, disposed approximately transverse to the central longitudinal plane 15. A beam-shaped support 17 is disposed on the top of the implement frame 8 above the grader blade 16, extending vertically to the plane 15. To both ends of the beam-shaped support 17 are linked lifting drives 18 and 18′ in the form of piston-cylinder drives, which can be acted upon hydraulically. For this purpose their cylinders 19, 19′ are supported pivotable in all directions in bearings 20, 20′ which surround them fork-like. These bearings 20, 20′ have a set distance a from the central longitudinal plane 15. The piston rods 21, 21′ of the drives 18, 18′ are connected with the support girder 13 and thus with the grader blade 16 by means of joints 22, 22′ at a distance b from the central longitudinal plane 15 which approximately corresponds to the distance a. These drives 18, 18′ are used to press the grader blade 16 against the ground 4 or to lift it off the ground 4.

Further drives, such as pivot drives and the like, have been omitted for reasons of clarity because they are of no consequence within the scope of the present description. The drives 18, 18′ can be hydraulically relieved, so that the grader blade 16 is in a so-called float position in which it rests on the ground 4 by its own weight. To the extent that the grader has been described so far, it is generally known and widely used.

Figure 3:
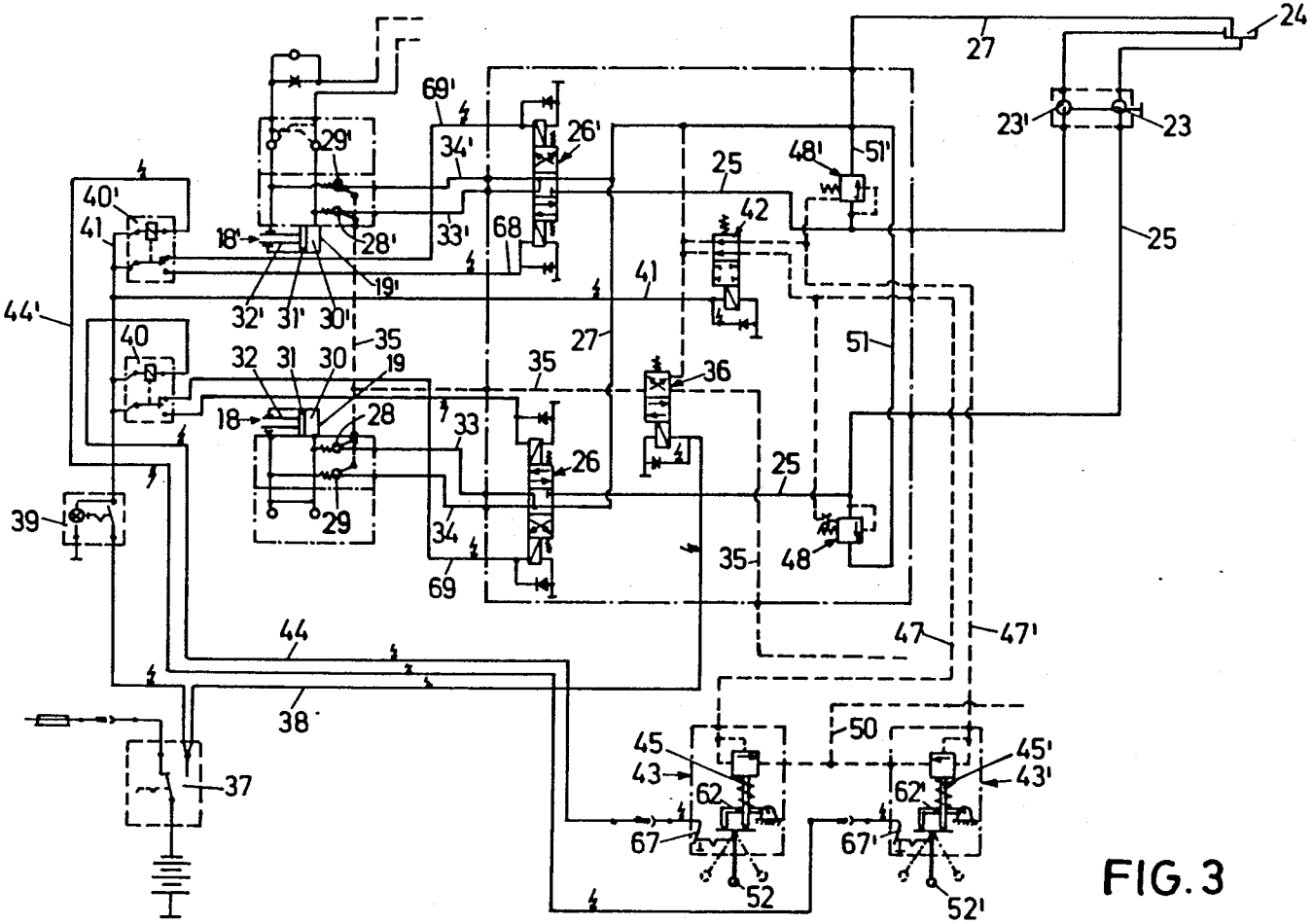
FIG. 3 is a hydraulic circuit diagram for the control of the piston-cylinder drives of the grader blade.

FIG. 3 shows the devices by means of which the drives 18, 18′ are controlled. Because the drives 18, 18′ are each separately controllable, all elements are provided in duplicate; those associated with drive 18 are indicated by a reference numeral and those associated with drive 18′ are indicated by the same reference numeral and a raised stroke and are not again described in each individual case. Lines for the working fluid, by means of which the drives 18 or 18′ are charged, are shown by solid lines. Lines for control fluids, by means of which their valves are controlled, are shown by dashed lines. Electrical lines for the control of valves are shown by solid lines and are each marked with a lightning symbol.

A continuously driven pump 23 is provided for supplying the drive 18 with hydraulic fluid, and aspirates the hydraulic fluid from a reservoir 24 and routes it to a 4/3-way valve 26 via a main pressure line 25. A return line 27 leads back to the reservoir 24 from this valve 26.

Two pilot controlled check valves 28, 29 are placed upstream of the drive 18, the check valve 28 being placed upstream of the chamber in the cylinder 19 designated as piston chamber 30, in which the entire piston 31 is charged with working fluid. The check valve 29 is placed upstream of the chamber in the cylinder 19 designated as piston ring chamber 32, through which passes the piston rod 21 and in which therefore only one surface of the piston 31 is charged with working fluid. From the 4/3-way valve 26 two lines 33, 34 lead to the check valves 28, 29 and correspondingly into the piston chamber 30 or the piston ring chamber 32. The check valves 28, 29 and 28′, 29′ are all connected to a control line 35, in which a solenoid valve 36 is placed. Supply with control fluid takes place from the central hydraulic system of the grader or from an associated pump or the like, which is not shown in the drawings. Operation of this solenoid valve 36 takes place via a line 38 by means of an electrical main switch 37. By closing the electrical main switch 37 the solenoid valve 36 is opened, so that control fluid flows via the control line 35 to the check valves 28, 29 and 28′, 29′ and opens them, so that the piston chambers 30, 30′ and the piston ring chambers 32, 32′ are connected to the common return line 27 via the 4/3-way valves 26 or 26′. The drives 18, 18′ are no longer under pressure because of this; the grader blade 16 rests on the ground under its own dead weight. If the grader blade 16 is lowered or raised against its own dead weight because of irregularities in the ground, corresponding amounts of hydraulic fluid flow from the piston chamber 30 into the piston ring chamber 32 and vice versa. Differential amounts flow via the return line 27 to the reservoir 24 or are aspirated from there.

Figure 4:
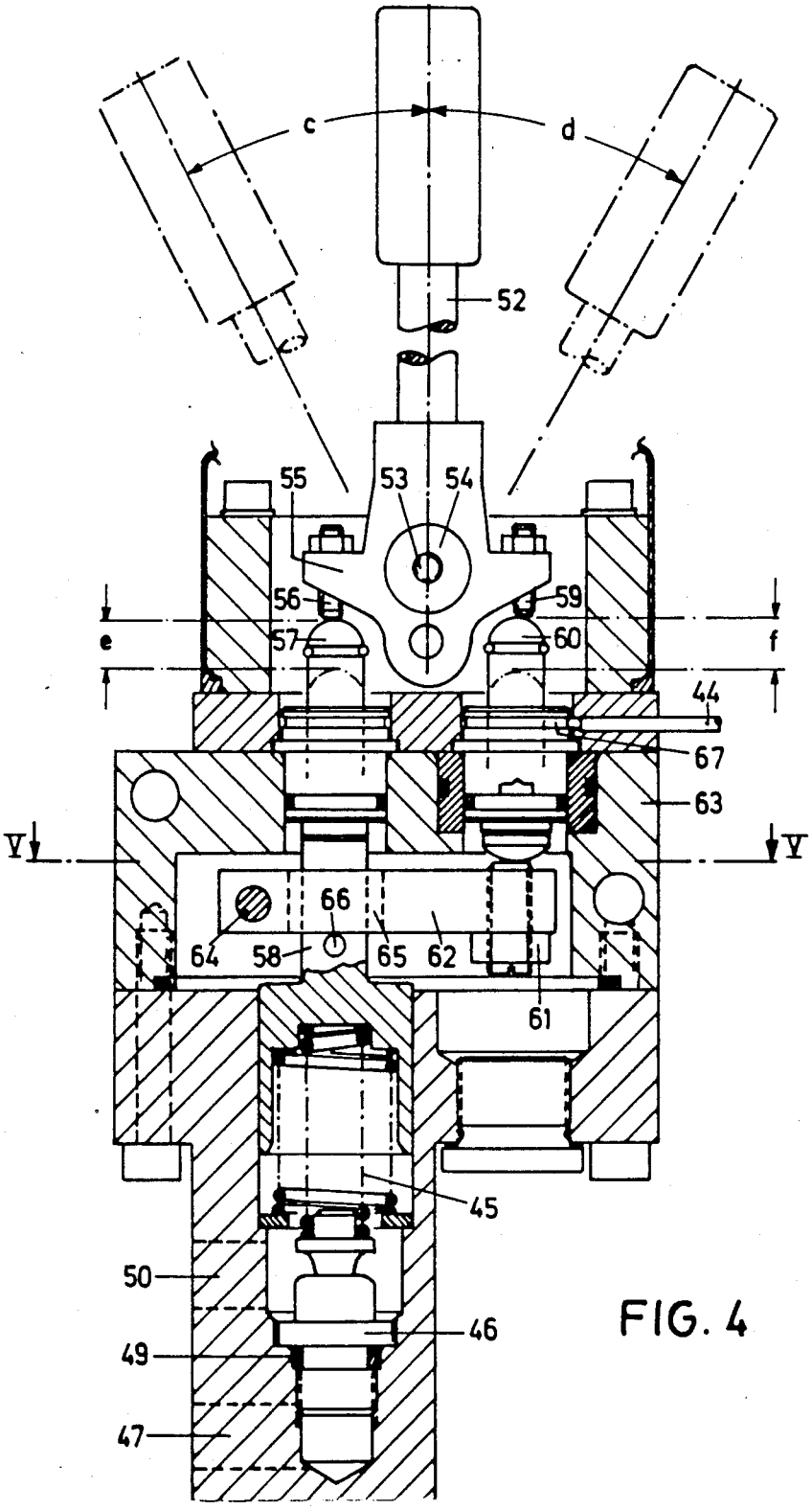
FIG. 4 is a longitudinal section through a pilot valve.

As shown in FIGS. 3 and 4, additional steps are provided to additionally press the grader blade 16 in its previously described float position against the ground 4 or to partially relieve it via one or both drives 18, 18′.

For this purpose a supplemental switch 39 is connected at the outlet side of the main switch 37, by means of the closing of which, when the main switch 37 is also closed, two relays 40, 40′ are supplied with voltage and are activated via an electric line 41. This line 41 leads to a solenoid valve 42 which is opened when the supplemental switch 39 is closed.

Additionally, a pilot valve 43 is supplied with voltage via a line 44. This pilot valve 43 or 43′ is shown in detail in FIGS. 4 and 5.

The pilot valve 43 has a valve piston 46 loaded by a compression spring 45. The valve piston 46 is connected, on the side facing away from the compression spring 45, with a control line 47, which is connected to a main pressure relief valve 48. When the pressure in this control line 47 becomes so great that the valve piston 46 rises from the valve seat 49 against the force of the compression spring 45, control fluid flows out of the control line 47 via a return line 50 to which both pilot valves 43, 43′ are connected. Thus the pressure within the control line 37 remains at a value set by the initial tension of the compression spring 45.

The main pressure relief valve 48 is located in the main pressure line 25, on which acts the pressure of the working fluid in the main pressure line 25 as control pressure on the one hand and, on the other, this control pressure is opposed by the pressure in the control line 47. The main pressure relief valve 48 is connected to the reservoir 24 via a relief line 51. Depending on the pressure in the control line 47 a corresponding pressure arises in the main pressure line 25. If the compression spring 45 presses with greater force against the valve piston 46, the pressure in the control line 47 rises; by a corresponding closing of the main pressure relief valve 48 the pressure in the main pressure line 25 rises correspondingly. If the force of the compression spring 45 is reduced, the pressure in the control line 47 is lowered; the main pressure relief valve 48 causes a corresponding lowering of the pressure in the main pressure line 25.

The initial tension of the compression spring 45 can be set by means of an operating lever 52 which can be pivoted around an angle c or d, which are suitably identical, from a neutral center position. The operating lever is pivotable around an axis 53 and a friction clutch 54 is provided so that the operating lever 52 remains in any pivoted position by self-locking. A lever 55 is disposed on the operating lever 52 vertically to the latter's longitudinal direction, one end of which abuts by means of an adjusting screw 56 via an intermediate bolt 57 on a control bolt 58 which, in turn, abuts on the compression spring 45. When the operating lever is pivoted—to the left in FIG. 4—by a portion of the angle c or the entire angle c, the compression spring 45 is compressed with a corresponding increase of its initial tension, maximally by the amount of the maximal stroke e of the intermediate bolt 57 and thus of the control bolt 58.

An adjusting screw 59 is associated with the other end of the lever 55 and abuts on a slidable indexing bolt 60 disposed parallel to the intermediate bolt 57. The maximum stroke f of this indexing bolt 60 during pivoting of the operating lever 52—to the right in FIG. 4—by the angle d may be equal to the maximal stroke e which, however, is not absolutely required.

Figure 5:
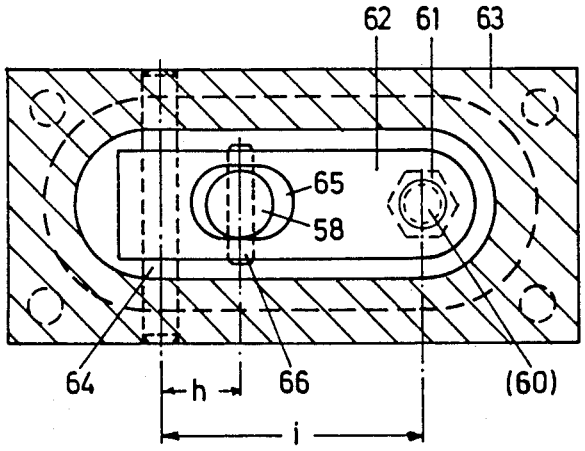
FIG. 5 is a cross section through the pilot valve along the line V—V of FIG. 4.

The indexing bolt 60 abuts with its end opposite to the adjusting screw 59 on a further adjusting screw 61 of a control lever 62. Seen from the direction of the indexing bolt 60, this control lever 62 is pivotably mounted on the other side of the control bolt 58 on a pivot shaft 64 which is supported on the housing 63 of the pilot valve 43. It has a slot-shaped recess 65 through which extends the control bolt 58. The control bolt 58 has a driving pin 66 extending crosswise through it on which rests the control lever 62. If the operating lever 52 is pivoted in such a way that the indexing bolt 60 is being operated, the latter pivots the control lever 62 around the pivot shaft 64 and, by means of the driving pin 66, takes the control bolt 58 along, which compresses the compression spring 45. As shown in FIGS. 4 and 5, in the course of an equal stroke of the intermediate bolt 57 on the one hand and of the indexing bolt 60 on the other hand the control bolt 58 is, in this latter case, displaced only by an amount resulting from the reduction ratio of the control lever 62, i.e. the increase in the initial stress of the compression spring 45 is less. This reduction ratio g is defined as the ratio of the distance h of the pivot shaft 64 from the control bolt 58 to the distance i of the pivot shaft 64 to the indexing bolt 60, the distances from center to center always being intended, i.e. $g=h:i$ applies. The distance i is in any case a multiple of the distance h.

Pivoting of the operating lever 52—left in FIG. 4—for a direct increase of the initial tension of the compression spring 45 via the intermediate bolt 57 leads to a greater increase of the pressure in the control line 47 than pivoting of the operating lever 52 in the opposite direction.

An electric switch 67 is associated with the indexing bolt 60 which activates the relay 40 via the line 44 when the operating lever 52 is moved in a predetermined direction. The 4/3-way valve 26 is controlled by the relay 40, depending on the switch position, either via the line 68 or the line 69. Control takes place such that, when the operating lever 52 is moved to achieve a direct (greater) increase of the initial tension of the compression spring 45, the 4/3-way valve 26 is switched so that the piston chamber 30 is connected with the main pressure line 25 via the line 33. In this case the corresponding drive 18 is charged with the pressure of the working fluid in such a way that the grader blade 16 is pressed against the ground 4 with a force exceeding its dead weight. The amount of this additional pressure depends on the pressure of the working fluid which, as already explained, depends on how great the closing pressure of the compression spring 45 against the valve piston 46 is.

If, however, the operating lever 52 is moved in the opposite direction so that the compression spring 45 is compressed via the control lever 62, the piston ring chamber 32 of the drive 18 is charged with working fluid, i.e. the drive 18 exerts a force on the grader blade 16 which is directed against the dead weight of the grader blade upwardly away from the ground 4.

It is a condition for the pilot valves 43, 43' taking effect that there be a continuous pressure of a control fluid via the control lines 47, 47' against the valve pistons 46. This is the case if the solenoid valve 42 is opened by closing the supplemental switch 39, so that pressure is present at the pilot valves 43, 43' which also is present in the float position at the opened check valves 28, 29 and 28', 29' and thus in the control line 35.

The lifting force of both drives 18, 18' maximally corresponds to the weight of the grader blade 16 plus the proportional weight of the support girder 13. The maximal total force of the drives 18, 18' towards the ground 4 is less than the total weight of the grader, because if a certain force exerted by the grader blade 16 against the ground 4 is exceeded, steerability of the vehicle decreases, because the steerable front wheels 11 are relieved of too much of the load. The ratio of lifting force to pressure force may lie, for example, in the range of up to 1 to 5. There is a corresponding ratio of the pressures of the working fluids, but it should be kept in mind that the effective cross section of the piston chamber 30 is respectively larger than the corresponding cross section of the piston ring chamber 32.

As already mentioned, each drive 18, 18' can be controlled via its own pilot valve 43 or 43', so that asymmetric relief or load of the grader blade 16 is possible in the float position if, for example, ice is to be scraped off the edge of the road in winter.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A grader for grading ground comprising:

a grader blade arranged generally transverse to a center longitudinal plane of a vehicle;

at least one lifting drive connected between said grader blade and said vehicle on each side of the center longitudinal plane and at a distance therefrom, each said lifting drive comprising a piston cylinder drive having a cylinder in which a piston rod is disposed, a piston attached to one end of the piston rod and slidably disposed in the cylinder, a piston ring chamber at the end of the cylinder traversed by the piston rod and a piston chamber at the other end of the cylinder separated from the piston ring chamber by the piston and free from being traversed by the piston rod, each of the drives being selectively chargeable with a working fluid under pressure, ports of the piston ring chamber and the piston chamber of each said drive being adapted to be opened substantially simultaneously in order to bring the grader blade into a float position in which said grader blade follows the contour of the ground with a downward force corresponding to its dead weight, and wherein the piston chamber and the piston ring chamber of each drive are each selectively chargeable with working fluid under a controllable pressure while the grader blade is in the float position, so that each selected drive exerts a force on the grader blade which increases or decreases the downward pressure of the greater blade on the ground while still allowing the grader blade to follow the contour of the ground.

2. A grader in accordance with claim 1, wherein the total force exerted by all drives to reduce the downward pressure of the grader blade on the ground maximally corresponds to the force resulting from the dead weight of the grader blade.

3. A grader in accordance with claim 1, wherein the maximum force increasing the downward pressure of the grader blade on the ground corresponds to a multiple of the maximum force which reduces the downward pressure.

4. A grader in accordance with claim 3, wherein the maximum force increasing the downward pressure of the grader blade on the ground is approximately three to five times greater than the maximum force decreasing the downward pressure.

5. A grader in accordance with claim 1, wherein the piston chamber and the piston ring chamber of each drive comprise a check valve open in the float position, a selector valve disposed upstream of the check valve by means of which working fluid under pressure can be supplied either to the piston chamber or the piston ring chamber, and a pressure relief valve controlling the pressure of the working fluid and adjustable to vary the pressure of the working fluid assigned to the selector valve.

6. A grader in accordance with claim 5, wherein the selector valve is a 4/3-directional valve.

7. A grader in accordance with claim 5, wherein the pressure relief valve comprises a valve piston, an initially tensioned compression spring for charging the valve piston, an operating lever for varying the initial tension of the compression spring and which, for setting a pressure of the working fluid for reducing the downward pressure of the grader blade, effects a lesser increase of the initial tension of the compression spring than for setting the pressure of the working fluid for increasing the downward pressure of the grader blade.

8. A grader in accordance with claim 7, wherein the operating lever directly acts on the compression spring when increasing the downward pressure and acts via a control lever effecting a step-down when decreasing the downward pressure.

9. A grader in accordance with claim 8, wherein a control bolt abuts on the compression spring, on one end of which acts the operating lever directly or via the control lever.

10. A grader in accordance with claim 5, wherein an electrical switch is connected with the operating lever by means of which, when the operating lever is moved, the selector valve is switched to the supply pressure to chamber of the drive assigned to the switching direction of the operating lever.

11. A grader in accordance with claim 5, wherein the pressure relief valve is used as pilot valve for controlling the pressure of a control fluid for a main pressure relief valve which controls the pressure of the working fluid.

* * * * *